US005425579A

United States Patent [19]

Sampson

[11] Patent Number: 5,425,579

[45] Date of Patent: Jun. 20, 1995

[54] BEVERAGE PITCHER WITH AGITATOR

[76] Inventor: Edwin J. Sampson, 400 Tabor Ave., No. 31, Fairfield, Calif. 94533

[21] Appl. No.: 290,476

[22] Filed: Aug. 15, 1994

[51] Int. Cl.[6] ..... B01F 7/20

[52] U.S. Cl. ..... 366/130; 366/314

[58] Field of Search ..... 366/96–98, 366/129, 130, 197, 199, 204, 205, 206, 241, 314; 241/199.2, 199.12, 277, 282.1, 282.2; 99/348

[56] References Cited

U.S. PATENT DOCUMENTS

| | | | |
|---|---|---|---|
| 1,103,949 | 7/1914 | Ecklyn . | |
| 1,480,914 | 1/1924 | Poplawski et al. . | |
| 1,997,873 | 4/1935 | Poplawski . | |
| 2,191,830 | 2/1940 | Leedy . | |
| 2,940,738 | 6/1960 | Posener et al. . | |
| 3,036,614 | 5/1962 | Knapp . | |
| 3,128,996 | 4/1964 | Kuzara . | |
| 3,677,524 | 7/1972 | Douglas | 366/130 |
| 3,738,583 | 6/1973 | Berland et al. . | |
| 3,785,579 | 1/1974 | Voglesonger | 241/282.1 |
| 4,133,016 | 1/1979 | Tanguy | 241/282.1 X |
| 4,149,271 | 4/1979 | Uibel et al. . | |
| 4,435,084 | 3/1984 | Calhoun et al. . | |
| 4,487,509 | 12/1984 | Boyce | 366/314 |
| 4,577,975 | 3/1986 | McCrory et al. | 366/314 |
| 4,887,909 | 12/1989 | Bennett | 366/206 X |

*Primary Examiner*—Charles E. Cooley
*Attorney, Agent, or Firm*—Thomas R. Lampe

[57] ABSTRACT

Beverage pitcher apparatus including a beverage container with an agitator and a removable support housing including a motor connected to the agitator when the beverage container and support housing are tightly screwed together and form a fluid-tight compartment for the motor.

9 Claims, 2 Drawing Sheets

BEVERAGE PITCHER WITH AGITATOR

TECHNICAL FIELD

This invention relates to a beverage pitcher, and more particularly, to a beverage pitcher which provides for the agitating or stirring of the contents of the pitcher.

BACKGROUND ART

The constituent components of beverages of certain types, such as orange juice, have a tendency to separate out or layer when temporarily stored in a pitcher. This problem has been recognized in the past and a number of devices have been devised for mixing or agitating beverages or other liquids in containers. There are, of course, food processors or mixers specifically designed to act upon the contents of a receptacle in many ways, including blending, mixing, liquifying, chopping and so forth. Many devices of this latter type are quite expensive and relatively complex.

The following patents are believed to be representative of the state of the prior art in this field: U.S. Pat. No. 4,435,084, issued Mar. 6, 1984, U.S. Pat. No. 4,149,271, issued Apr. 10, 1979, U.S. Pat. No. 3,738,583, issued Jun. 12, 1973, U.S. Pat. No. 3,128,996, issued Apr. 14, 1964, U.S. Pat. No. 3,036,614, issued May 29, 1962, U.S. Pat. No. 2,940,738, issued Jun. 14, 1960, U.S. Pat. No. 2,191,830, issued Feb. 27, 1940, U.S. Pat. No. 1,480,914, issued Jan. 15, 1924, and U.S. Pat. No. 1,103,949, issued Jul. 21, 1914.

U.S. Pat. No. 4,435,084 is worthy of particular discussion in that it relates to an automatic stirrer for a cup including an agitator blade which rotates to stir up the contents of the cup. A battery operated motor is disposed in a recess at the bottom of the cup and is actuated by means of an on-off switch located on the cup handle.

Cleaning of the cup of U.S. Pat. No. 4,435,084 would appear to be a considerable problem. First of all, there is no arrangement in the disclosed cup for ensuring that liquid will not enter the chamber below the cup false bottom and damage the motor and related components. Removal of the lowermost wall of the cup, if such indeed is possible, would expose the motor and related components to direct contact by wash water and the like. There appears to be no way to separate the drive mechanism and electrical components of the device shown in U.S. Pat. No. 4,435,084 from the cup portion per se.

DISCLOSURE OF INVENTION

The present invention relates to beverage pitcher apparatus which allows for ready removal of the beverage container portion from structure including an electrically powered drive motor so that the container can be used and cleaned separately, if desired. Furthermore, the beverage pitcher apparatus of the present invention incorporates structure which ensures that the motor and related drive mechanism positioned in a separate support housing are maintained in a water-tight condition when connected to the beverage container portion of the apparatus.

The beverage pitcher apparatus of the present invention includes a beverage container having a container bottom and a container side wall projecting upwardly from the container bottom. The container bottom and container side wall define a container interior for receiving and temporarily storing a beverage. The beverage container additionally comprises a skirt extending downwardly from the container bottom and defining a recess.

The apparatus includes an agitator having a rotatable blade disposed within the container interior above the container bottom. A drive shaft is affixed to the blade and rotatably mounted in the container bottom. The drive shaft has a shaft distal end extending below the container bottom into the recess.

A support housing is provided defining a housing interior and having a housing bottom.

Connector means releasably tightly connects together the support housing and the beverage container. The recess and the housing interior are in communication and comprise a closed, water-tight compartment when the beverage container and the support housing are tightly connected together by the connector means.

An electric motor is connected to the support housing and disposed in the housing interior along with battery means for driving the electric motor.

Transmission means is located within the housing interior and connected to the motor. The transmission means is engageable by the drive shaft when the beverage container and the support housing are connected together.

First electrical contact means is on the beverage container. Second electrical contact means is on the support housing. The first electrical contact means and the second electrical contact means are in engagement to allow completion of an electrical circuit and energization of the electric motor by the battery when the beverage container and the support housing are tightly connected together by the connector means. The first electrical contact meads and the second electrical contact means are out of engagement to open an electrical circuit and prevent energization of the electric motor by the battery when the beverage container and the support housing are not tightly connected together by the connector means.

Other features, advantages, and objects of the present invention will become apparent with reference to the following description and accompanying drawings.

BEST MODE FOR CARRYING OUT THE INVENTION

Figure 1:
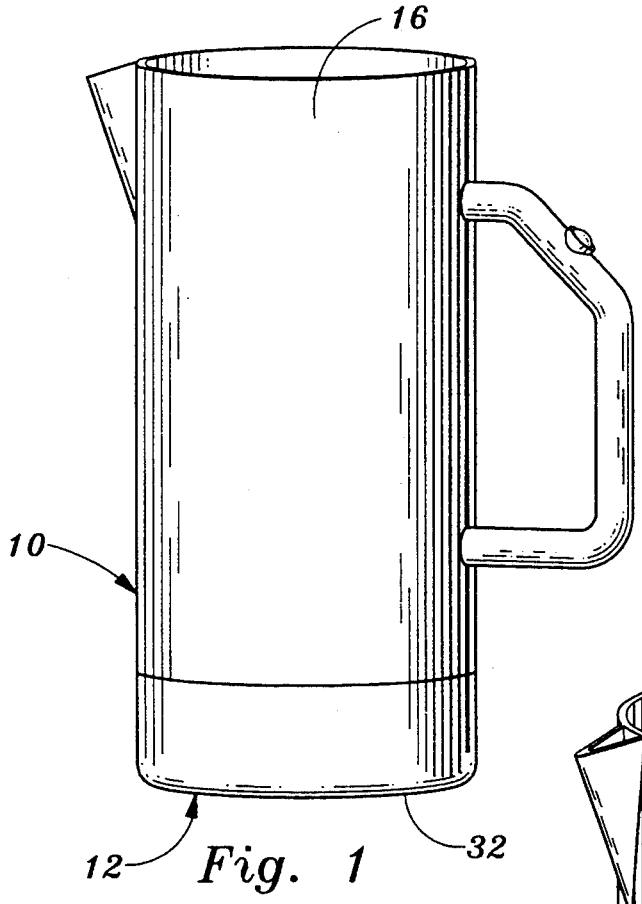
FIG. 1 is a perspective view illustrating the fully assembled beverage pitcher apparatus of the present invention.
Figure 2:
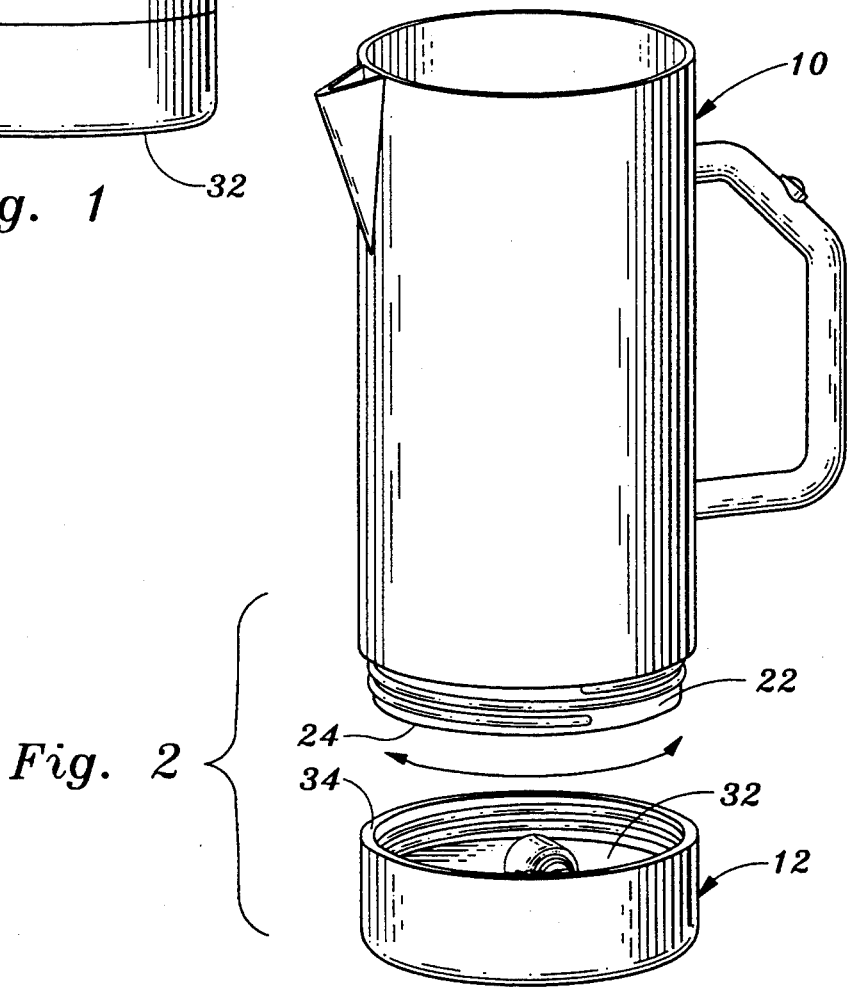
FIG. 2 is a perspective view illustrating the beverage container of the apparatus separated from the support housing.

Referring now to the drawings, beverage pitcher apparatus constructed in accordance with the teachings of the present invention includes a beverage container 10 and a support housing 12.

Container 10 includes a bottom 14 and a side wall 16 projecting upwardly from the bottom. The bottom and side wall define a container interior for receiving and temporarily storing a beverage.

A skirt 18 extends downwardly from the container bottom and defines a recess 20. The skirt has a threaded outer surface 22. The skirt 18 projects downwardly from the bottom 14 inwardly of the container side wall 16 to define an abutment surface 24 extending between the side wall and the skirt.

Figure 4:
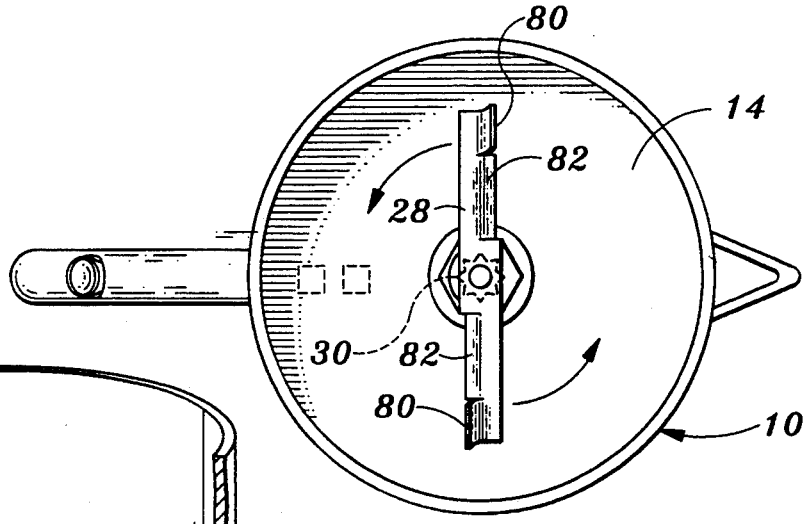
FIG. 4 is a top plan view of the beverage container.
Figure 3:
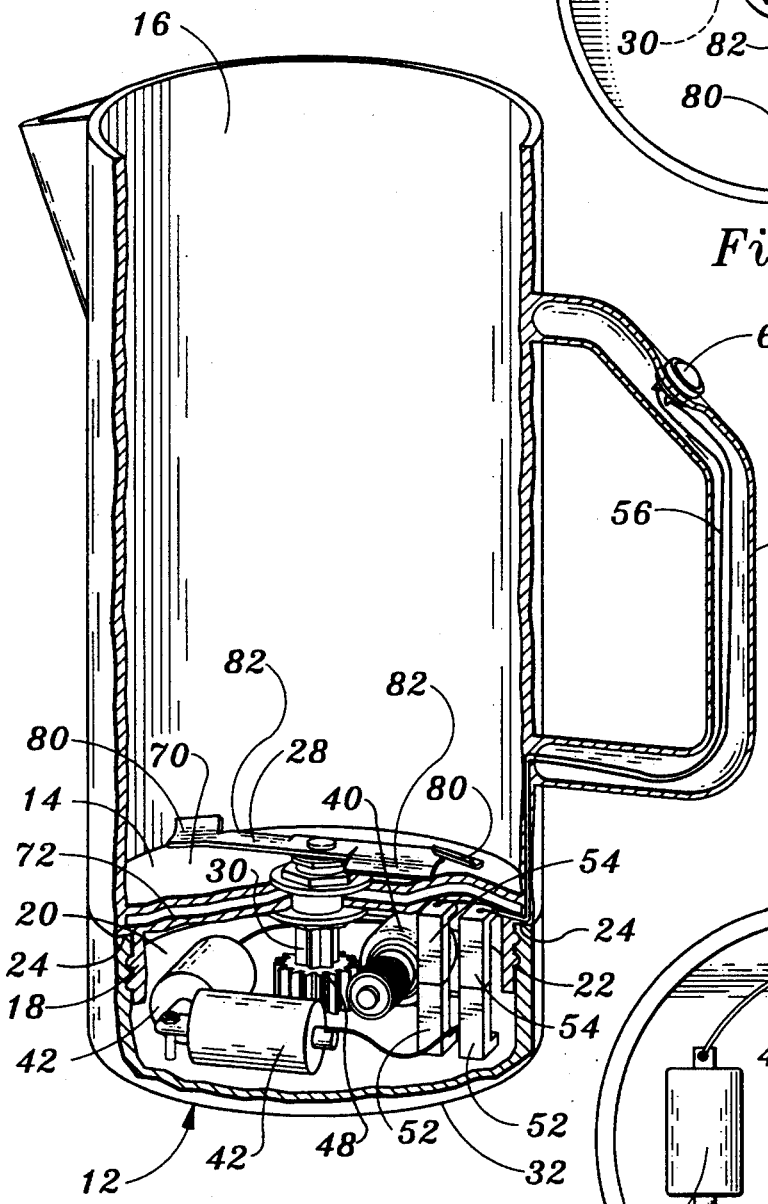
FIG. 3 is an enlarged perspective view with a cutaway section illustrating internal components of the beverage pitcher apparatus.
Figure 5:
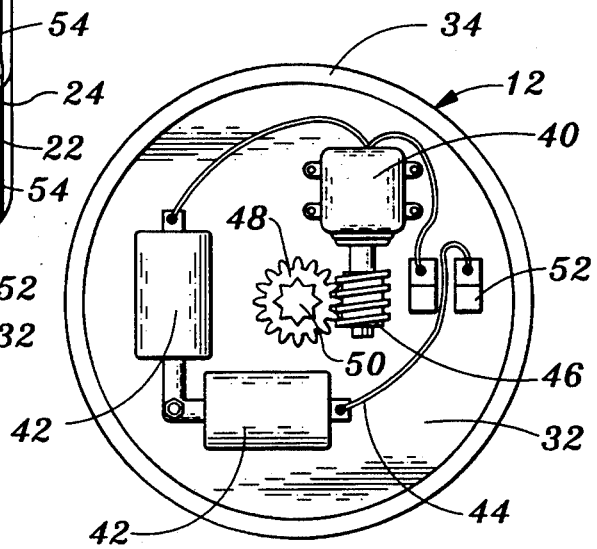
FIG. 5 is a top plan view of the support housing and related components housed in the interior thereof.

A rotatable agitator blade 28 is located within the container interior above the bottom thereof. A drive shaft 30 is attached to the blade 28 and extends through the bottom 14. Shaft 30 has a distal end which is gear shaped as shown in FIGS. 3 and 4. The distal end terminates within recess 20, i.e. above the lower end of skirt 18.

Support housing 12 defines a housing interior above a flat housing bottom 32. The side wall of the support housing is threaded internally to matingly engage the threaded outer surface 22 of the skirt 18. The support housing and beverage container may thus be selectively threadedly engaged or disengaged as desired. The lower end of the skirt 18 provides a support for the beverage container 10 when the support housing 12 has been removed therefrom.

The upper end of the side wall of the support housing 12 forms an upper rim or abutment surface 34 which tightly engages abutment surface 24 when the beverage container and support housing are completely threaded together as shown in FIG. 1. Thus, the interior of support housing 12 and the recess 20 within skirt 18 of the container will form a closed, water-tight compartment when the beverage container and the support housing are tightly connected together by the connector threads. It will of course be appreciated that suitable conventional seal structure is provided about the agitator drive shaft 30 to ensure that there will be no leakage of liquid from the beverage container interior into the support housing interior.

An electric motor 40 is located within the confines of support housing 12 and secured to bottom 32 of the support housing. The motor is connected in series with batteries 42 disposed within the support housing by conventional wiring 44. The output shaft 46 is in the form of a worm gear which drives a gear member 48 rotatably mounted on bottom 32 adjacent to the output shaft. Gear member 48 defines a central recess 50 for receiving the distal end of drive shaft 30 when the beverage container and support housing are connected together. Thus, rotation of the motor output shaft 46 will serve to rotate the agitator blade 28.

The electrical circuitry of the apparatus also includes two electrical contact elements 52 secured to the bottom 32 of the support housing and two electrical contact elements 54 secured to bottom 14 of beverage container 10. The electrical contact elements 54 are encompassed by the skirt 18 and do not extend below the lower end of the skirt so as not to interfere with the skirt's ability to support the beverage container when the beverage container is not employed with the support housing.

Wires 56 extend from the electrical contact elements 54 into side wall 16 of the beverage container and into the hollow interior of a handle 58. An on-off switch 60 of conventional construction is deployed on the handle and connected to wires 56.

With particular reference to FIG. 3, it will be noted that electrical contact elements 52 are in engagement with electrical contact elements 54 only when the beverage container 10 and support housing 12 are secured together in tight relationship with the abutment surfaces 24, 34 pressed against one another to ensure a fluid-tight condition within the confines of the skirt and the support housing. The person using the pitcher can actuate the stirring device by pushing switch 60.

In the event, however, that the beverage container and support housing are not fully screwed together into a liquid-tight relationship, the electrical contact elements 52, 54 will not be in engagement and actuation of switch 60 will fail to complete the electrical circuit of which electric motor 40 is a part. This means that the entire assemblage of the beverage container and support housing can be washed with no possibility of leakage into the electrical components of the apparatus when depression of the switch will result in rotation of the agitator blade. If the user depresses a switch and finds that the blade is not rotating, this is an indicator that a fluid-tight condition may not exist between the beverage container and support housing.

The apparatus incorporates two other features of note. The bottom 14 is of double bottom wall construction, the bottom walls 70, 72 being spaced apart, Such an arrangement inhibits formation of condensate on the lowermost bottom wall 72 which could corrode or otherwise harm the electrical components within the support housing.

The second feature pertains to the construction of agitator blade 28. Blade 28 is bent upwardly at end segments 80 thereof, the end segments 80 directing liquid in the container 10 upwardly as the blade rotates. Inwardly of the end segments, the blade includes downturned segments 82. Downturned segments 82 will direct liquid in the container 10 downwardly as the blade rotates. Such a blade configuration results in highly efficient and effective agitation and mixing of the container contents upon rotation of the blade.

I claim:

1. Beverage pitcher apparatus comprising, in combination:

a beverage container having a container bottom and a container side wall projecting upwardly from said container bottom, said container bottom and container side wall defining a container interior for receiving and temporarily storing a beverage, said beverage container additionally comprising a skirt extending downwardly from said container bottom and defining a recess;

an agitator including a rotatable blade disposed within said container interior above said container bottom and a drive shaft affixed to said blade rotatably mounted in said container bottom and having a shaft distal end extending below said container bottom into said recess;

a support housing defining a housing interior and having a housing bottom;

connector means for releasably tightly connecting together said support housing and said beverage container, said recess and said housing interior being in communication and comprising a closed, water-tight compartment when said beverage container and said support housing are tightly connected together by said connector means;

an electric motor connected to said support housing and disposed in said housing interior;

battery means connected to said support housing and disposed in said housing interior for driving said electric motor;

transmission means within said housing interior connected to said motor engageable by said drive shaft when said beverage container and said support housing are connected together;

first electrical contact means on said beverage container; and second electrical contact means on said support housing, said first electrical contact means and said second electrical contact means being in engagement to allow completion of an electrical circuit and energization of said electric motor by said battery means when said beverage container and said support housing are tightly connected together by said connector means, and said first electrical contact means and said second electrical contact means being out of engagement to open an electrical circuit and prevent energization of said electric motor by said battery means when said beverage container and said support housing are not tightly connected together by said connector means.

2. The beverage pitcher apparatus according to claim 1 additionally comprising an electrical switch on said beverage container connected to said first electrical contact means.

3. The beverage pitcher apparatus according to claim 2 wherein said beverage container has a handle and wherein said electrical switch is located on said handle.

4. The beverage pitcher apparatus according to claim 1 wherein said first electrical contact means and said second electrical contact means each comprises two contact elements.

5. The beverage pitcher apparatus according to claim 1 wherein said skirt partially comprises said connector means and includes a threaded skirt surface, said support housing including a threaded housing surface matingly engageable with said threaded skirt surface to connect together said beverage container and said support housing.

6. The beverage pitcher apparatus according to claim 1 wherein said skirt projects downwardly from said container bottom inwardly of said container side wall to define a container abutment surface on the container bottom extending between said container side wall and said skirt, said support housing having a support housing abutment surface engaging said container abutment surface when said support housing and said beverage container are tightly connected together by said connector means.

7. The beverage pitcher apparatus according to claim 1 wherein said skirt has a lower end for supporting said beverage container upon removal of said beverage container from said support housing, said shaft distal end located above the lower end of said skirt.

8. The beverage pitcher apparatus according to claim 1 wherein said container bottom includes two spaced apart bottom walls.

9. The beverage pitcher apparatus according to claim 1 wherein said rotatable blade includes upturned and downturned blade segments for directing liquid in the beverage container both up and down upon rotation of the rotatable blade.

* * * * *